US008353640B2

(12) United States Patent
Sawyer

(10) Patent No.: US 8,353,640 B2
(45) Date of Patent: Jan. 15, 2013

(54) LOAD SUPPORTING PANEL HAVING IMPACT ABSORBING STRUCTURE

(75) Inventor: Steven Lee Sawyer, Castel San Giovanni (IT)

(73) Assignee: Brock USA, LLC, Boulder, CO (US)

( * ) Notice: Subject to any disclaimer, the term of this patent is extended or adjusted under 35 U.S.C. 154(b) by 42 days.

(21) Appl. No.: 13/025,745

(22) Filed: Feb. 11, 2011

(65) Prior Publication Data

US 2011/0135852 A1 Jun. 9, 2011

Related U.S. Application Data

(63) Continuation-in-part of application No. 12/830,902, filed on Jul. 6, 2010, and a continuation-in-part of application No. 12/009,835, filed on Jan. 22, 2008, now Pat. No. 8,236,392.

(60) Provisional application No. 61/303,350, filed on Feb. 11, 2010.

(51) Int. Cl.
*E01C 13/08* (2006.01)
*B32B 3/24* (2006.01)

(52) U.S. Cl. ..... 404/4; 404/2; 404/27; 404/31

(58) Field of Classification Search ..... 404/17, 404/27–39; 428/17, 92, 95, 218
See application file for complete search history.

(56) References Cited

U.S. PATENT DOCUMENTS 3,577,894 A * 5/1971 Emerson et al. ..... 404/31
3,757,481 A * 9/1973 Skinner ..... 52/265
3,974,312 A 8/1976 Stevens et al.
4,007,307 A 2/1977 Friedrich
4,287,693 A * 9/1981 Collette ..... 52/177
4,389,435 A 6/1983 Haas, Jr.
4,497,853 A 2/1985 Tomarin
4,501,420 A 2/1985 Dury
4,505,960 A 3/1985 Leffingwell
4,535,021 A 8/1985 Friedrich
4,629,358 A * 12/1986 Springston et al. ..... 404/35

(Continued)

FOREIGN PATENT DOCUMENTS

JP 54032371 U 3/1979

(Continued)

OTHER PUBLICATIONS

Ecore International ShockPad Brochure. Retrieved from Internet: <www.regupol.com> Jan. 14, 2008.

(Continued)

*Primary Examiner* — Raymond W Addie
(74) *Attorney, Agent, or Firm* — MacMillan, Sobanski & Todd, LLC

(57) ABSTRACT

An impact absorption panel is adapted for playground use and comprises a panel section and a plurality of projections. The panel section is defined by a top surface and a bottom surface. The plurality of projections extend from the bottom surface of the panel section. The plurality of projections have a first stage and a second stage. The first stage is configured to collapse initially when subjected to an impact load. The second stage is configured to provide greater resistance to the impact load than the first stage. The panel section is configured to provide greater resistance to the impact load than the first and second stages. The first stage can also be distinguished from the second stage by virtue of having a comparatively smaller volume.

20 Claims, 7 Drawing Sheets

U.S. PATENT DOCUMENTS

| | | | | |
|---|---|---|---|---|
| 4,946,719 | A | 8/1990 | Dempsey | |
| 5,019,194 | A | 5/1991 | Friedrich | |
| 5,044,821 | A * | 9/1991 | Johnsen | 405/50 |
| 5,098,673 | A | 3/1992 | Engel et al. | |
| 5,292,130 | A * | 3/1994 | Hooper | 473/279 |
| 5,383,314 | A * | 1/1995 | Rothberg | 52/169.5 |
| 5,460,867 | A * | 10/1995 | Magnuson et al. | 428/178 |
| 5,467,462 | A | 11/1995 | Fujii | |
| 5,489,462 | A | 2/1996 | Sieber | |
| 5,514,722 | A | 5/1996 | Di Geronimo | |
| 5,605,721 | A | 2/1997 | Di Geronimo | |
| 5,888,614 | A * | 3/1999 | Slocum et al. | 428/132 |
| 5,916,034 | A * | 6/1999 | Lancia | 473/157 |
| 5,957,619 | A * | 9/1999 | Kinoshita et al. | 404/31 |
| 5,976,645 | A | 11/1999 | Daluise et al. | |
| 6,221,445 | B1 | 4/2001 | Jones | |
| 6,616,542 | B1 | 9/2003 | Reddick | |
| 6,740,387 | B1 | 5/2004 | Lemieux | |
| 6,796,096 | B1 | 9/2004 | Heath | |
| 6,818,274 | B1 | 11/2004 | Buck et al. | |
| 6,858,272 | B2 | 2/2005 | Squires | |
| 6,877,932 | B2 | 4/2005 | Prevost | |
| 7,014,390 | B1 | 3/2006 | Morris | |
| 7,090,430 | B1 | 8/2006 | Fletcher | |
| 7,131,788 | B2 * | 11/2006 | Ianniello et al. | 405/50 |
| 7,244,477 | B2 | 7/2007 | Sawyer | |
| 7,487,622 | B2 * | 2/2009 | Wang | 52/384 |
| 7,516,587 | B2 * | 4/2009 | Barlow | 52/591.2 |
| 7,563,052 | B2 * | 7/2009 | Van Reijen | 404/28 |
| 7,722,287 | B2 * | 5/2010 | Swank | 404/73 |
| 7,771,814 | B2 * | 8/2010 | Grimble et al. | 428/156 |
| D637,318 | S | 5/2011 | Sawyer | |
| 2001/0002497 | A1 * | 6/2001 | Scuero | 14/73 |
| 2003/0039511 | A1 | 2/2003 | Prevost | |
| 2004/0058096 | A1 | 3/2004 | Prevost | |
| 2005/0028475 | A1 | 2/2005 | Barlow | |
| 2005/0089678 | A1 | 4/2005 | Mead | |
| 2006/0045994 | A1 | 3/2006 | Dipple et al. | |
| 2006/0121236 | A1 | 6/2006 | Prevost | |
| 2006/0141231 | A1 | 6/2006 | Lemieux | |
| 2008/0113161 | A1 | 5/2008 | Grimble et al. | |
| 2008/0176010 | A1 * | 7/2008 | Sawyer et al. | 428/27 |
| 2009/0188172 | A1 * | 7/2009 | DuCharme et al. | 52/11 |

FOREIGN PATENT DOCUMENTS

| | | | |
|---|---|---|---|
| JP | 8049209 | A | 2/1996 |
| JP | 2000073525 | A | 3/2000 |
| KR | 200121867 | Y1 | 9/1998 |
| KR | 200313921 | Y1 | 5/2003 |
| KR | 1020040010413 | A | 1/2004 |
| WO | 02/09825 | A1 | 2/2002 |
| WO | 03/000994 | A1 | 1/2003 |
| WO | 2004/011724 | A1 | 2/2004 |
| WO | 2007/002442 | A1 | 1/2007 |

OTHER PUBLICATIONS

A-Turf A-Turf Premier-R 45/2.25 LSR 3-Part Spec. Retrieved from Internet: <www.aturf.com> Jan. 14, 2008.

Schmitz Foam Products ProPlay for sports areas and playgrounds Brochure. Retrieved from Internet: <www.schmitzfoam.com> Nov. 1, 2006.

Sirex 3R Foam—Recycled, Post Industrial, Cross-Link, Closed Polyethylene Foam The Product Brochure. Retrieved from Internet: <www.recycledfoam.com/product.html> Nov. 1, 2006.

Sirex 3R Foam—Recycled, Post Industrial, Cross-Link, Closed Polyethylene Foam 3R-Foam Application Brochure. Retrieved from Internet: <www.recycledfoam.com/applications_sports_outdoor.html> Nov. 1, 2006.

XLGeneration XL Turf, The XL Technology Brochure. Retrieved from Internet: <www.xlturf.com/xltechnology.html> Nov. 1, 2006.

XLGeneration XL Turf, Product Tests Brochure. Retrieved from Internet: <www.xlturf.com/tests.html> Nov. 1, 2006.

XLGeneration XL Turf, The Athletic Dynamic Response System (ADR) Brochure. Retrieved from Internet: <www.xlturf.com/adr.html> Nov. 1, 2006.

Mark Harrison, Factors Affecting the Results of the 'Berlin Artificial Athlete' Shock Absorption Test. Mar. 9, 1999 Retrieved from Internet: <www.isss.de/publications/ArtificalAthlete/mark039.html>.

WO2008/088919 PCT Search Report.

PCT International Search Report, Application No. PCT/US11/024475, Date Feb. 11, 2010.

European Search Report, 10195632.4, dated Apr. 12, 2012.

European Search Report, 10195633.2, dated Apr. 12, 2012.

* cited by examiner

LOAD SUPPORTING PANEL HAVING IMPACT ABSORBING STRUCTURE

CROSS-REFERENCE TO RELATED APPLICATIONS

This application is a continuation-in-part patent application of U.S. patent application Ser. No. 12/009,835, filed Jan. 22, 2008 now U.S. Pat. No. 8,236,392, and U.S. patent application Ser. No. 12/830,902, filed Jul. 6, 2010, the disclosure of both applications are incorporated herein by reference. This application also claims the benefit of U.S. Provisional Application No. 61/303,350, filed Feb. 11, 2010, the disclosure of which is incorporated herein by reference.

BACKGROUND OF THE INVENTION

This invention relates in general to impact absorbing underlayment panels. In particular, this invention relates to underlayment panels having deformable elements that compress in a plurality of stages such that a load absorbing gradient is provided in response to an applied force.

Surfaces such as playgrounds and athletic mats, for example, are scrutinized for their effect on impact forces that cause related injuries to users. Attempts have been made to minimize the force or energy transferred to a user's body in the event of a fall. Various surface designs that rely on ground materials or layered fabric materials may help reduce the transfer of impact forces. These surface designs, however, are limited by the ability of the materials to spread the impact load over a large area. Thus, it would be desirable to provide a surface having improved impact force absorption and dissipation characteristics.

SUMMARY OF THE INVENTION

This invention relates to an impact absorption panel having a top side and a bottom side. The top side includes a plurality of drainage channels that are in fluid communication with a plurality of drain holes. The plurality of drain holes connect the top side drainage channels with a plurality of bottom side channels. The bottom side channels are defined by sides of adjacent projections that are disposed across the bottom side.

This invention also relates to an impact absorption panel having a top side and a bottom side where the bottom side has a plurality of projections disposed across at least a portion of the bottom surface. The projections have a first spring rate characteristic and a second spring rate characteristic. The first spring rate characteristic provides for more deflection under load than the second spring rate characteristic.

In one embodiment, an impact absorption panel comprises a top surface and a bottom surface. The top surface has a three dimensional textured surface and a plurality of intersecting drainage channels. The bottom surface is spaced apart from the top surface and defines a panel section therebetween. A plurality of projections is disposed across at least a portion of the bottom surface. The projections have a first stage that defines a first spring rate characteristic and a second stage defining a second spring rate characteristic. The first spring rate characteristic provides for more deflection under load than the second spring rate characteristic. The plurality of projections also cooperate during deflection under load such that the adjacent projections provide a load absorption gradient over a larger area than the area directly loaded. In another embodiment, the first stage has a smaller volume of material than the second stage. Additionally, the adjacent projections define a bottom surface channel to form a plurality of intersecting bottom surface channels and a plurality of drain holes connect the top surface drainage channels with the plurality of bottom surface channels at the drainage channel intersections.

In another embodiment, an impact absorption panel includes a top surface and a bottom surface that define a panel section. A plurality of projections are supported from the bottom surface, where the projections include a first stage having a first spring rate and a second stage having a second spring rate. The first stage is configured to collapse initially when subjected to an impact load, the second stage is configured to provide greater resistance to the impact load than the first stage, and the panel section is configured to provide greater resistance to the impact load than the first and second stages. The first stage is also configured to compress and telescopically deflect, at least partially, into the second stage. A portion of the bottom surface is generally coplanar with the truncated ends of adjacent projections such that the coplanar bottom surface portion is configured to provide a substantial resistance to deflection under load compared with the first and second stages. This coplanar configuration of the bottom surface provides a structural panel section having a thickness that is generally equal to the thickness of the panel section plus the length of the projections.

In yet another embodiment, an impact absorption panel system comprises a first panel and at least a second panel. The first panel has a top surface, a bottom surface, a first edge having a flange that is offset from the top surface and a second edge having a flange that is offset from the bottom surface. A plurality of projections are disposed across the bottom surface. The projections have a first spring rate characteristic and a second spring rate characteristic. The second panel has a top surface, a bottom surface, a first edge having a flange that is offset from the top surface and a second edge having a flange that is offset from the bottom surface. A plurality of projections are disposed across the bottom surface of the second panel and have a first spring rate characteristic and a second spring rate characteristic. One of the second panel first edge flange and the second edge flange engages one of first panel second edge flange and the first panel first edge flange to form a generally continuously flat top surface across both panels.

In one embodiment, the impact absorption panel is a playground base layer panel.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1B:
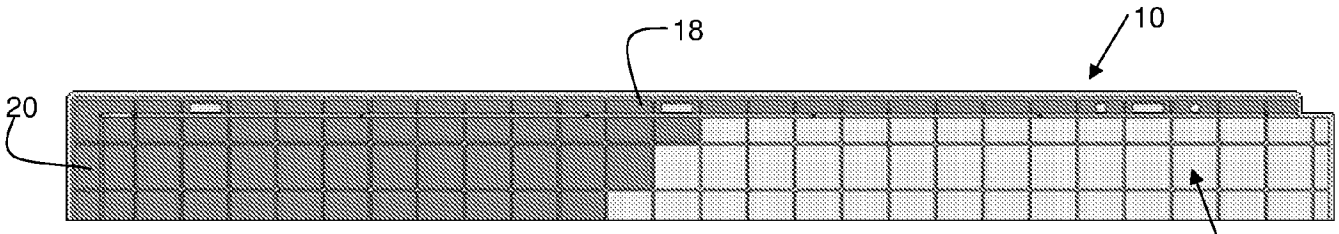
FIG. 1B is an enlarged elevational top view of an edge of the impact absorption panel of FIG. 1A.
Figure 1A:
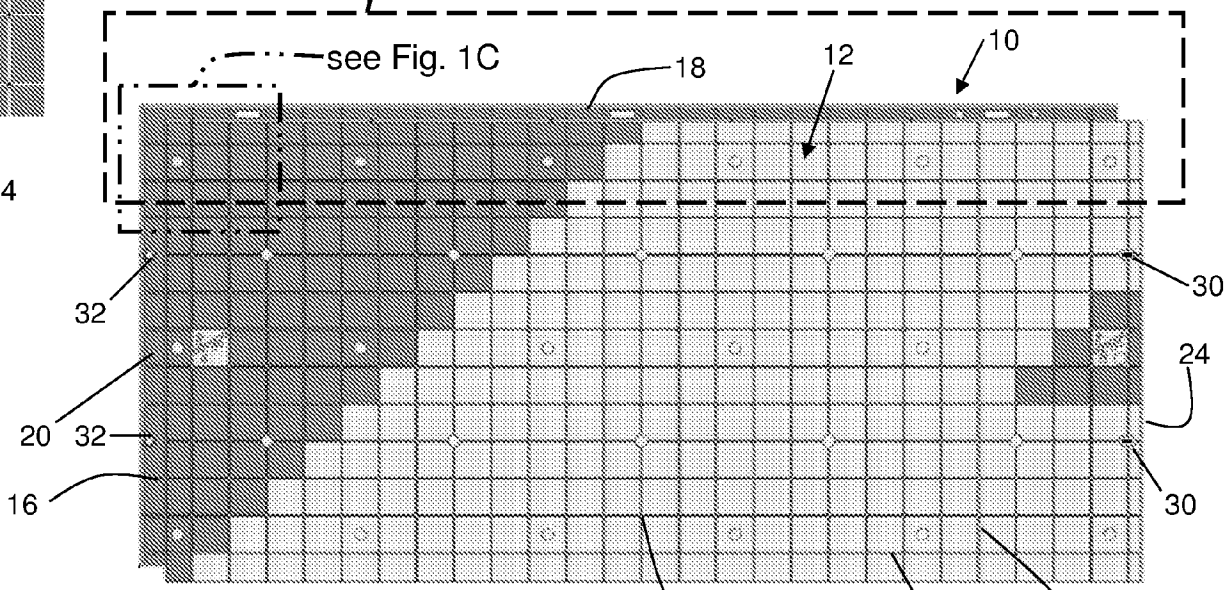
FIG. 1A is an elevational view of a top side of an embodiment of an impact absorption panel suitable as a playground base.
Figure 1C:
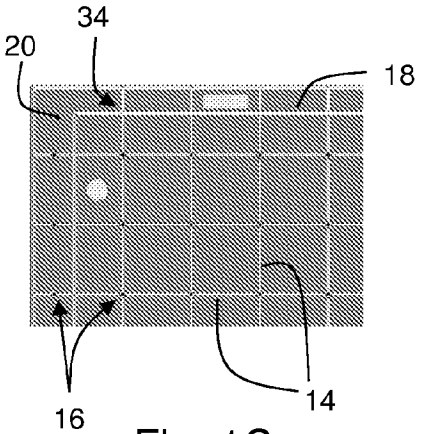
FIG. 1C is an enlarged elevational top view of a corner of the impact absorption panel of FIG. 1A.

Referring now to the drawings, there is illustrated in FIGS. 1A, 1B, and 1C a load supporting panel having an impact absorbing structure configured to underlie a playground area. The various embodiments of the impact absorbing panel described herein may also be used in indoor and outdoor impact environments other than playgrounds and with other types of equipment such as, for example, wrestling mats, gymnastic floor pads, carpeting, paving elements, loose infill material, and other covering materials. In certain embodiments, the panel is described as a single panel and is also configured to cooperate with other similar panels to form a base or impact absorbing panel system that is structured as an assemblage of panels. The panel, shown generally at 10, has a top surface 12 that is illustrated having a grid of drainage channels 14. Though shown as a grid of intersecting drainage channels 14, the drainage channels may be provided in a non-intersecting orientation, such as generally parallel drainage channels. In the illustrated embodiment, a drain hole 16 is formed through the panel 10 at the intersection points of the drainage channels 14. However, not every intersection point is required to include a drain hole 16. The drain holes 16 may extend through all or only a portion of the intersecting drainage channels 14 as may be needed to provide for adequate water dispersion. Though illustrated as a square grid pattern, the grid of drainage channels 14 may be any shape, such as, for example, rectangular, triangular, and hexagon.

Figure 2A:
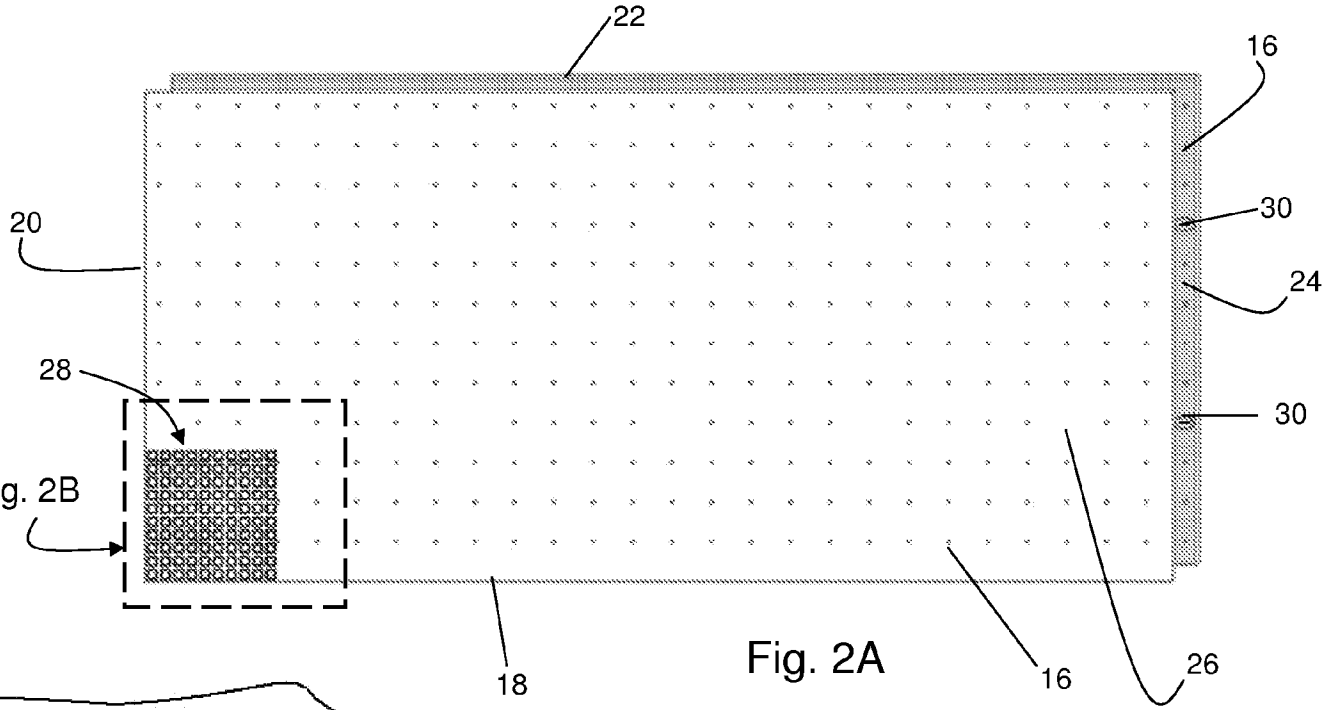
FIG. 2A is an elevational view of a bottom side of an embodiment of an impact absorption panel.

A first edge flange 18 extends along one side of the panel 10 and is offset from the top surface 12 of the panel 10. A second edge flange 20 extends along an adjacent side of the panel 10 and is also offset from the top surface 12. A third edge flange 22 and a fourth edge flange 24 are illustrated as being oriented across from the flanges 18 and 20, respectively. The third and fourth flanges 22 and 24 extend from the top surface 12 and are offset from a bottom surface 26 of the base 12, as shown in FIG. 2A. The first and second flanges 18 and 20 are configured to mate with corresponding flanges, similar to third and fourth flanges 22 and 24 that are part of another cooperating panel. Thus, the third and fourth flanges 22 and 24 are configured to overlap flanges similar to first and second flanges 18 and 20 to produce a generally continuous surface of top surfaces 12 of adjoining panels 10. A panel section 27, as shown in FIG. 5, is defined by the thickness of the panel between the top surface 12 and the bottom surface 26.

In an alternative embodiment, the panel 10 may be configured without the first through fourth flanges 18, 20, 22, and 24. In such a configuration, the resulting edges of the panel 10 may be generally flat and straight edges. In another embodiment, the generally straight edge may include projections (not shown) to create a gap between adjoining panels, as will be explained below. In yet another embodiment, the edges may be formed with an interlocking geometric shape similar to a jigsaw puzzle.

Figure 2B:
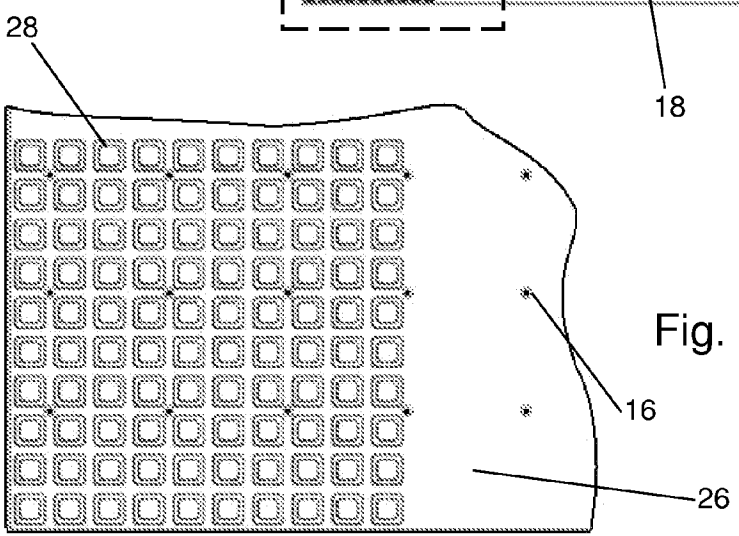
FIG. 2B is an enlarged elevational bottom view of a corner of the impact absorption panel of FIG. 2A.

Referring now to FIGS. 2A and 2B, there is illustrated the bottom surface 26 of the panel 10. The illustrated bottom surface 26 includes a plurality of projecting shock absorbing structures 28 disposed across the bottom surface 26. Only some of the projections 28 are shown on the bottom surface 26 so that the drain holes 16 may be clearly visible. Thus, in one embodiment, the projections 28 extend across the entire bottom surface 26. In another embodiment, the projections 28 may be arranged in a pattern where portions of the bottom surface have no projections 28. The portion having no projections 28 may have the same overall dimension as the thickness of the panel 10 including the projections 28. Such a section may be configured to support a structure, such as a table and chairs. This portion of the bottom surface 26 is configured to provide a structural support surface having a substantial resistance to deflection under load compared with the first and second stages 40 and 42.

Figure 4:
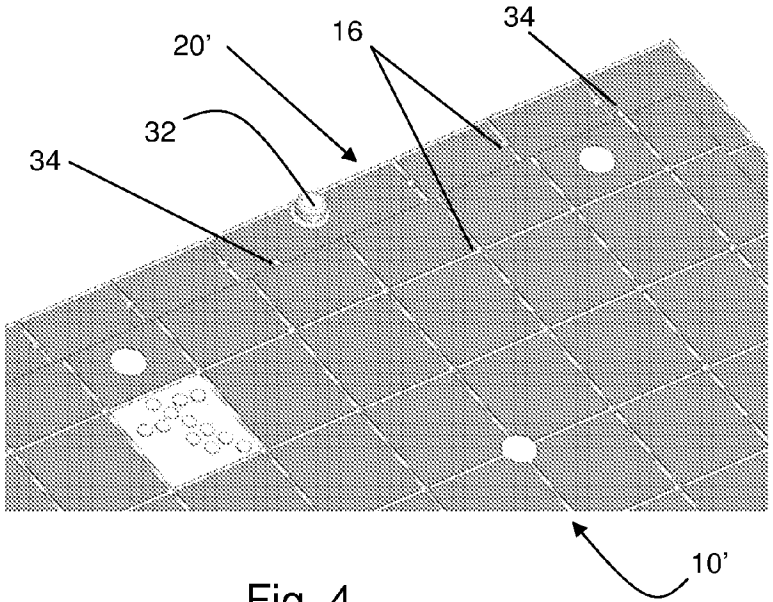
FIG. 4 is a perspective view of a panel interlocking feature configured to mate with the panel locking feature of FIG. 3.
Figure 3:
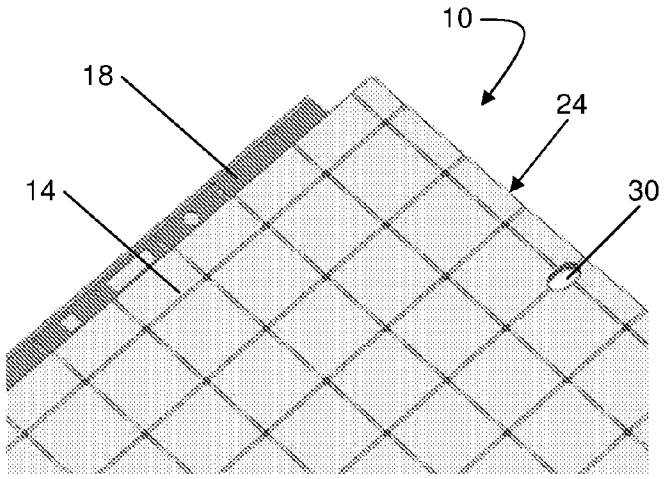
FIG. 3 is a perspective view of an embodiment of a panel interlocking feature of an impact absorption panel.
Figure 5:
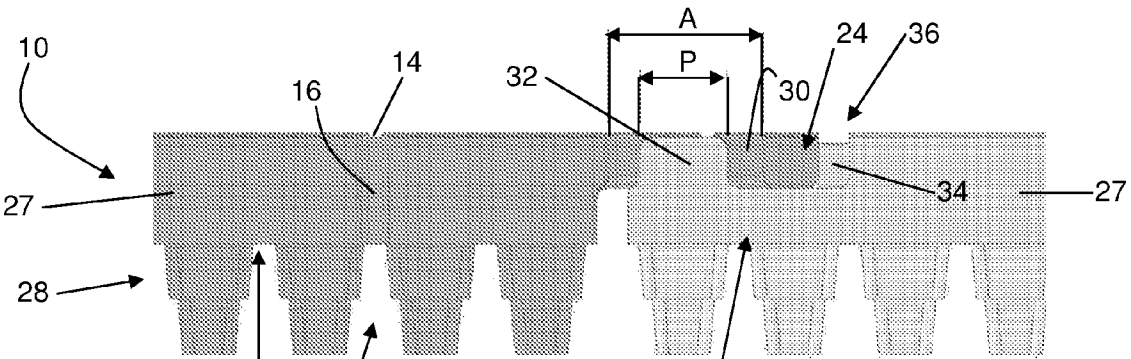
FIG. 5 is an elevational view, in cross section, of the assembled panel interlocking features of FIGS. 3 and 4.

Referring now to FIGS. 3, 4, and 5, the flange 24 is shown to include a locking aperture 30 as part of an interlocking connection to secure adjacent panels 10 together. A flange 20' of an adjacent panel 10' includes a locking projection 32. As shown in FIG. 5, the locking projection 32 is disposed within the locking aperture 30. The diameter of the locking projection is shown as "P", which is smaller than the diameter of the locking aperture, "A". This size difference permits slight relative movement between adjoining panels 10 and 10' to allow, for example, 1) panel shifting during installation, 2) thermal expansion and contraction, and 3) manufacturing tolerance allowance. In the illustrated embodiment, flange 18 does not include a locking projection or aperture 30, 32. However, in some embodiments all flanges 18, 20, 22, and 24 may include locking apertures and/or projections. In other embodiments, none of the flanges may have locking apertures and projections.

Some of the flanges include a standout spacer 34, such as are shown in FIGS. 4 and 5 as part of flanges 20, and 20'. The standout spacer 34 is positioned along portions of the transition between the flange 20' and at least one of the top surface 12 and the bottom surface 26. The standout spacer 34 establishes a gap 36 between adjacent panels to permit water to flow from the top surface 12 and exit the panel 10. The standout spacer 34 and the resulting gap also permit thermal expansion and contraction between adjacent panels while maintaining a consistent top surface plane. Alternatively, any or all flanges may include standout spacers 34 disposed along the adjoining edges of panels 10 and 10', if desired. The flanges may have standout spacers 34 positioned at transition areas along the offset between any of the flanges and the top or bottom surfaces 12 and 26.

Figure 6:
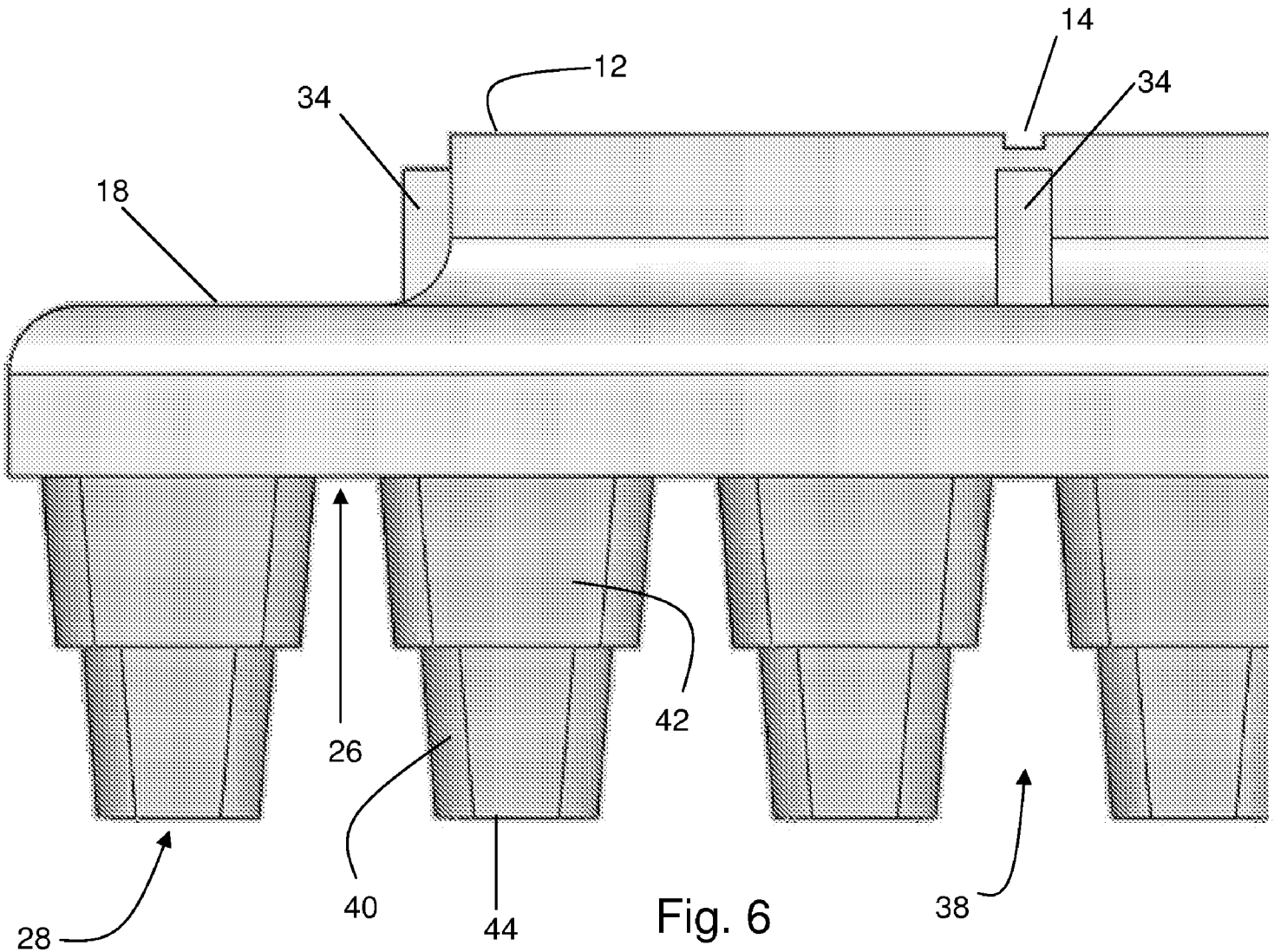
FIG. 6 is an enlarged elevational view of an embodiment of a shock absorbing projection of an impact absorption panel.
Figure 7:
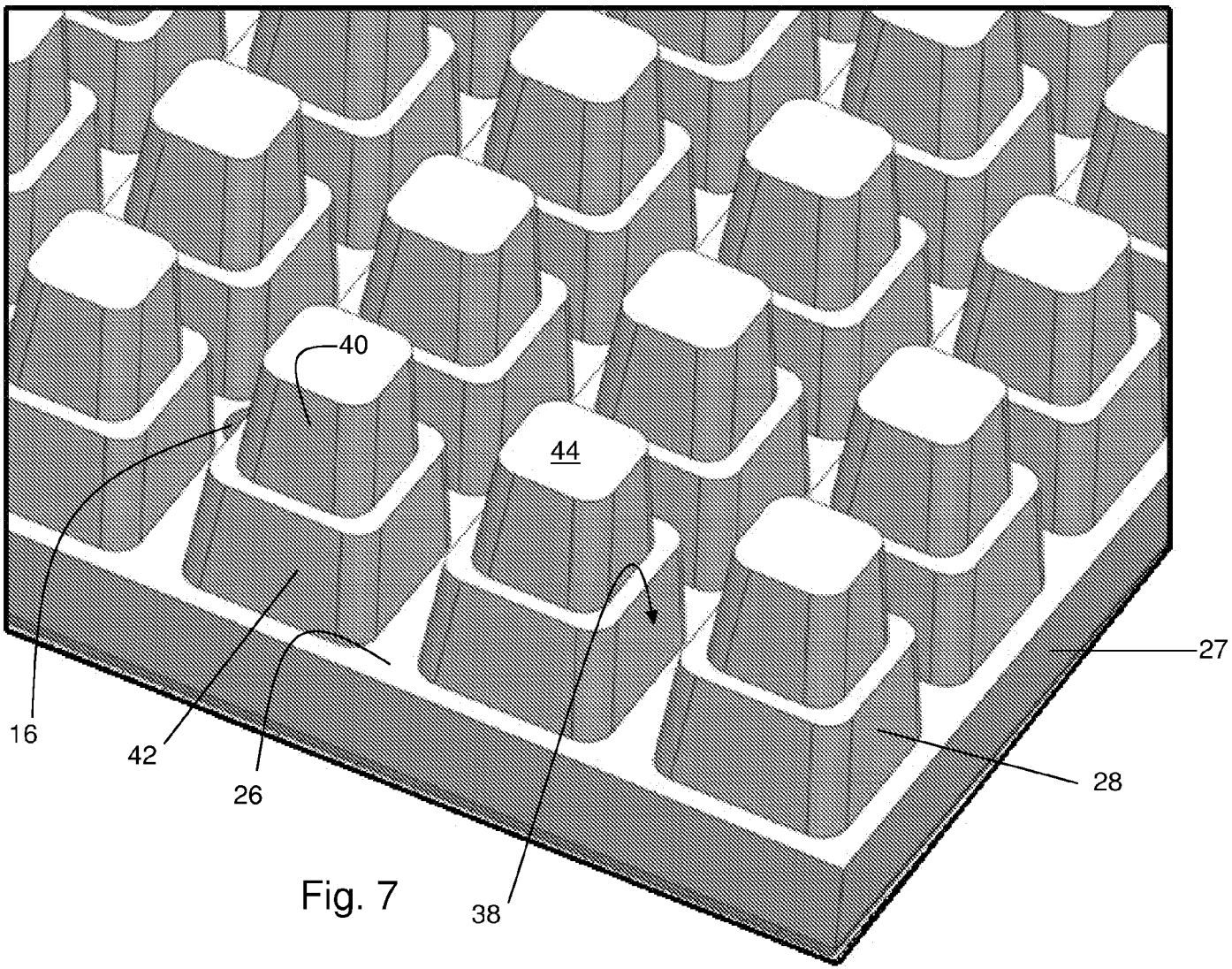
FIG. 7 is a perspective view of the bottom side of the impact absorption panel of FIG. 6.

Referring now to FIGS. 6 and 7 there is illustrated an enlarged view of the projections 28, configured as shock absorbing projections. The sides of adjacent projections 28 define a bottom channel 38. The bottom channels 38 are connected to the top drainage channels 14 by the drain holes 16. The bottom channels 38 permit water to flow from the top surface 12 through the drain holes 16 and into the ground or other substrate below the panel 10. In one embodiment, the bottom channels 38 may also store water, such as at least 25 mm of water, for a controlled release into the supporting substrate below. This slower water release prevents erosion and potential sink holes and depressions from an over-saturated support substrate. The channels 38 also provide room for the projections to deflect and absorb impact energy, as will be explained below. Additionally, the bottom channels 38 also provide an insulating effect from the trapped air to inhibit or minimize frost penetration under certain ambient conditions.

The shock absorbing projections 28 are illustrated as having trapezoidal sides and generally square cross sections. However, any geometric cross sectional shape may be used, such as round, oval, triangular, rectangular, and hexagonal. Additionally, the sides may be tapered in any manner, such as a frusto-conical shape, and to any degree suitable to provide a proper resilient characteristic for impact absorption. The projections 28 are shown having two absorption stages or zones 40 and 42. A first stage 40 includes a truncated surface 44 that is configured to support the panel 10 on the substrate or ground. The end of the first stage 40 may alternatively be rounded rather than a flat, truncated surface. In another alternative embodiment, the end of the first stage 40 may be pointed in order to be partially embedded in the substrate layer. A second stage or zone 42 is disposed between the bottom side 26 and the first stage 40. The second stage 42 is larger in cross section and volume than the first stage 40. Thus, the second stage 42 has a stiffer spring rate and response characteristic than that of the first stage 40. This is due to the larger area over which the applied load is spread. In another embodiment, the first stage 40 may be formed with an internal void, a dispersed porosity, or a reduced density (not shown) to provide a softer spring rate characteristic. In yet another embodiment, the first stage 40 may be formed from a different material having a different spring rate characteristic by virtue of the different material properties. The first stage 40 may be bonded, integrally molded, or otherwise attached to the second stage 42. Though the first and second stages 40 and 42 are illustrated as two distinct zones where the first stage 40 is located on a larger area side of the second stage 42, such is not required. The first and second stages 40 and 42 may be two zones having constant or smooth wall sides where the two zones are defined by a volume difference that establishes the differing spring rates. Alternatively, the projections 28 may have a general spring rate gradient over the entire projection length between the truncated end 44 and the bottom surface 26.

Figure 8B:
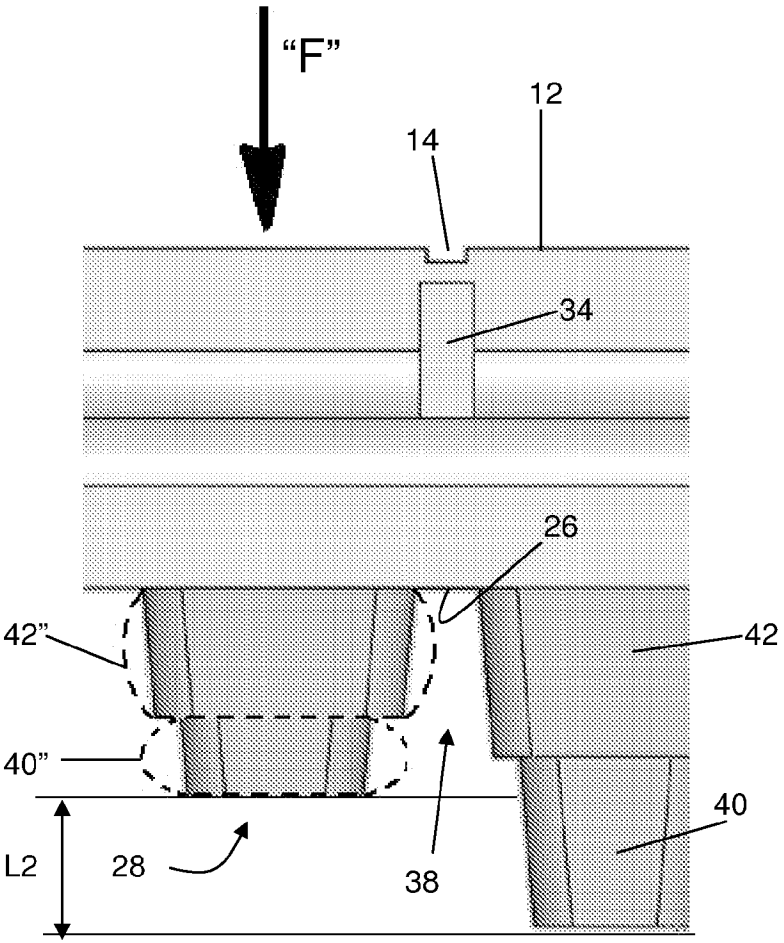
FIG. 8B is an enlarged elevational view of another embodiment of a deformed projection reacting to an impact load.
Figure 8A:
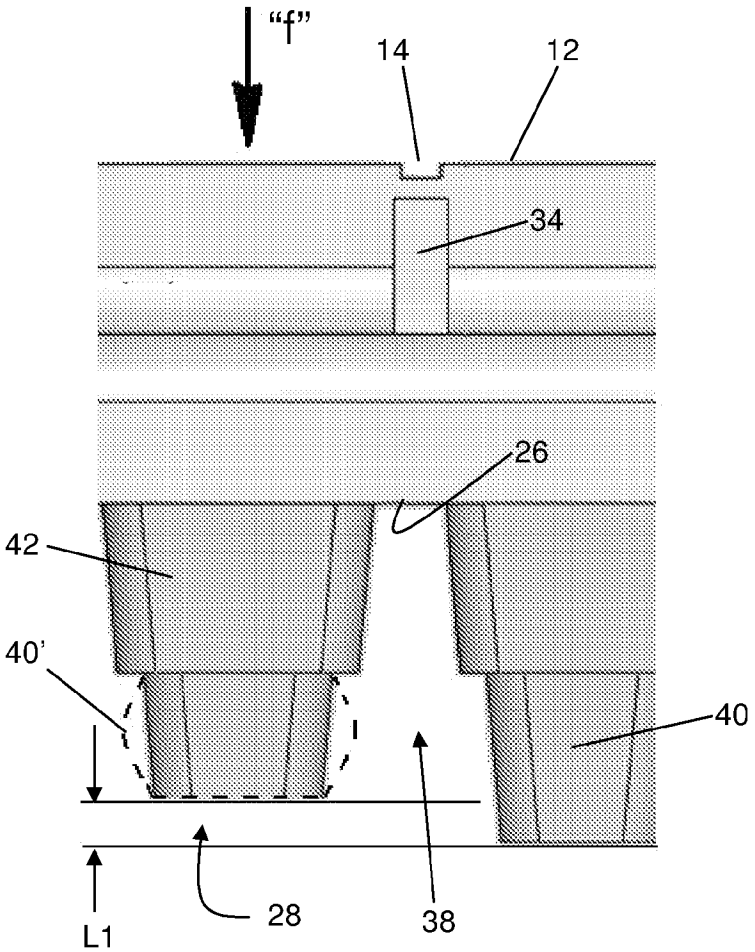
FIG. 8A is an enlarged elevational view of an embodiment of a deformed projection reacting to an impact load.

Referring to FIGS. 8A and 8B, the deflection reaction of the projection 28 is illustrated schematically. As shown in FIG. 8A, a load "f" is applied onto the top surface 12 representing a lightly applied impact load. The first stage 40 is compressed by an amount L1 under the load f and deflects outwardly into the channel 38, as shown by a deflected first stage schematic 40'. The second stage 42 may deflect somewhat under the load f but such a deflection would be substantially less than the first stage deflection 40'. As shown in FIG. 8B, a larger impact load "F" is applied to the top surface 12. The first and second stages 40 and 42 are compressed by an amount L2 under the load F, where the first stage 40 is compressed more than the second stage 42. The first stage 40 deflects outwardly to a deflected shape 40". The second stage 42 is also deflected outwardly to a deflected shape 42". Thus, the first and second stages 40 and 42 progressively deflect as springs in series that exhibit different relative spring rates. These deflected shapes 40', 40", and 42" are generally the shapes exhibited when an axial compressive load is applied to the top surface. The first and second stages 40 and 42 may also bend by different amounts in response to a glancing blow or shearing force applied at an angle relative to the top surface 12.

The projections 28 are also arranged and configured to distribute the impact load over a larger surface area of the panel 10. As the panel 10 is subjected to an impact load, either from the small load f or the larger load F, the projections deflect in a gradient over a larger area than the area over which the load is applied. For example, as the panel reacts to the large impact load F, the projections immediately under the applied load may behave as shown in FIG. 8B. As the distance increases away from the applied load F, the projections 28 will exhibit deflections resembling those of FIG. 8A. Thus, the projections 28 form a deflection gradient over a larger area than the area of the applied load. This larger area includes areas having deflections of both first and second stages 40 and 42 and areas having deflections of substantially only the first stage 40. Thus, under a severe impact, for example, in addition to the compression of the material in the area of the load, the first stage 40 (i.e., the smaller portions) of the projections compress over a wider area than the are of the point of impact. This load distribution creates an area elastic system capable of distributing energy absorption over a wide area. This produces significant critical fall heights, as explained below. This mechanical behavior of the projections 28 may also occur with tapered projections of other geometries that are wider at the top than at the bottom (i.e., upside down cones).

Figure 9:
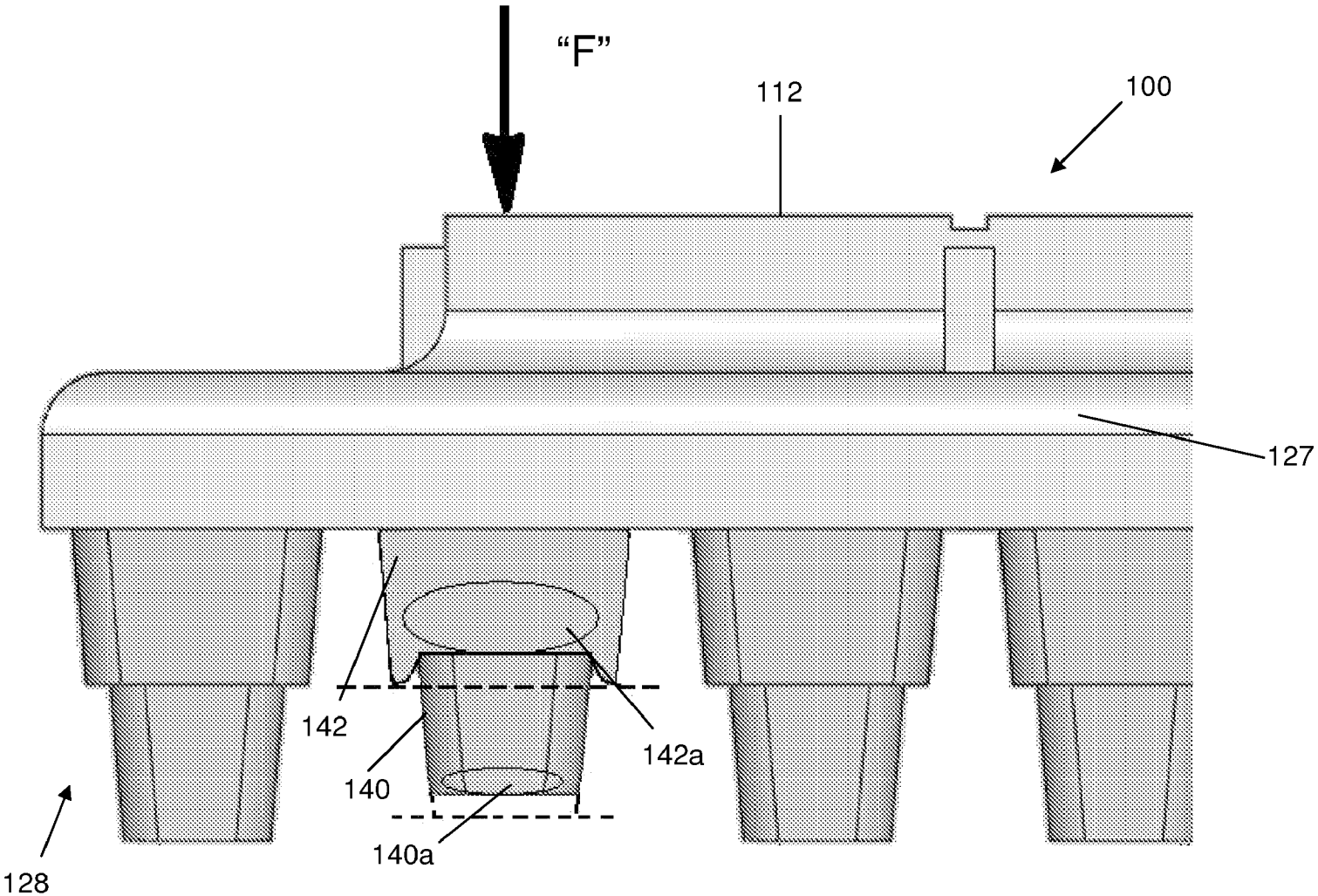
FIG. 9 is an enlarged elevational view of another embodiment of a deformed projection reacting to an impact load.

Referring now to FIG. 9 there is illustrated another embodiment of a panel 100 having projections 128 that exhibit a telescopic deflection characteristic. A first stage 140 of the projection 128 is deflected linearly into the second stage 142. During an initial portion of an impact load, the first stage 140 compresses such that the material density increases from an original state to a compressed state. A dense zone 140*a* may progress from a portion of the first stage 140 to the entire first stage. As the impact load increases, the first stage pushes against and collapses into the second stage 142. The second stage 142 compresses and permits the first stage to linearly compress into the second stage 142 similarly to the action of a piston within a cylinder. A second stage dense zone 142*a* may likewise progress from a portion of the second stage to the entire second stage. Alternatively, the dense zones 140*a* and 142*a* may compress proportionally across the entire projection 128.

The softness for impact absorption of the panel 100 to protect the users, such as children, during falls or other impacts is a design consideration. Impact energy absorption for fall mitigation structures, for example children's playground surfaces, is measured using HIC (head injury criterion). The head injury criterion (HIC) is used internationally and provides a relatively comparable numerical indicator based on testing. HIC test result scores of 1000 or less are generally considered to be in a safe range. The value of critical fall height, expressed in meters, is a test drop height that generates an HIC value of 1000. For example, to be within the safe zone, playground equipment heights should kept at or lower than the critical fall height of the base surface composition. The requirement for critical fall height based on HIC test values in playground applications may be different from the requirement for critical fall heights in athletic fields and similar facilities. Also, the HIC/critical fall height will vary based on the supporting substrate characteristics. In one embodiment, the panel 10 or the panel 100 may be configured to provide a 2.5 m critical fall height over concrete, when tested as a component of a playground surface, and a 2.7 m critical fall height over concrete in combination with a low pile (22 mm) artificial turf partially filled with sand. In another embodiment, the panel 10 or the panel 100 may provide a 3.0 m critical fall height over a compacted sand base in combination with a low pile (22 mm) artificial turf partially filled with sand. By comparison, conventional athletic field underlayment layers are configured to provide only half of these critical fall height values.

These HIC/critical fall height characteristic and figures are provided for comparison purposes only. The panel 10 or the panel 100 may be configured to absorb more or less energy depending on the application, such as swings, monkey bars, parallel bars, vertical and horizontal ladders, along with the ages of the intended users. In one embodiment, the projections 28 or 128 may have a first stage height range of 10-15 mm and a second stage height range of 15-25 mm. In another embodiment, the projections 28 or 128 may be configured to be in a range of approximately 12-13 mm in height for the first stage and 19-20 mm in height for the second stage in order to achieve the above referenced HIC figures. The panel 10 or the panel 100 may be made of any suitable material, such as for example, a polymer material. In one embodiment, the panel 10 or 100 is a molded polypropylene panel. However, the panel may be formed from other polyolefin materials.

The panels 10 or 100 may be assembled and covered with any suitable covering, such as for example, artificial turf, rubber or polymer mats, short pile carpeting, particulate infill, or chips such as wood chips or ground rubber chips.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An impact absorption panel having a top surface and a bottom surface, the top surface including a plurality of drainage channels that are in fluid communication with a plurality of drain holes, the plurality of drain holes connecting the top surface drainage channels with a plurality of bottom surface channels, the bottom surface channels being defined by sides of a plurality of adjacent projections disposed across the bottom surface and projecting downwardly.

2. The impact absorption panel of claim 1 wherein the adjacent projections each have a first spring rate characteristic and a second spring rate characteristic wherein the first spring rate characteristic provides for more deflection under load than the second spring rate characteristic.

3. The impact absorption panel of claim 2 wherein the first spring rate characteristic of the projections is part of a first stage and the second spring rate characteristic is part of a second stage.

4. The impact absorption panel of claim 3 wherein the first stage has a smaller volume of material than the second stage.

5. The impact absorption panel of claim 3 wherein the first stage is formed from a different material than the second stage.

6. The impact absorption panel of claim 3 wherein the first and second stages of the projections deflect as springs in series.

7. The impact absorption panel of claim 3 wherein the first stage is configured to collapse initially when subjected to an impact load, the second stage is configured to provide greater resistance to the impact load than the first stage, and a panel section is defined between the top surface and the bottom surface, the panel section being configured to provide greater resistance to the impact load than the first and second stages, the projections further including truncated ends.

8. The impact absorption panel of claim 7 wherein the second stage is configured to be dimensionally larger than the first stage.

9. The impact absorption panel of claim 7 wherein the top surface includes a three dimensional surface texture that creates friction to retain a covering layer and wherein a portion of the bottom surface is generally coplanar with the truncated ends of adjacent projections forming a coplanar bottom surface portion such that the coplanar bottom surface portion is configured to provide a structural support surface having a substantial resistance to deflection under load compared with the first and second stages.

10. The impact absorption panel of claim 7 wherein the top surface includes a molded topography configured to facilitate drainage.

11. The impact absorption panel of claim 7 wherein at least one flange extends from the panel section, the flange being configured to overlap with a mating panel flange such that the top surface and the bottom surface of one panel are generally continuous with the top surface and bottom surface of the adjacent panels.

12. The impact absorption panel of claim 7 wherein at least one flange extends from the panel section, the flange being configured to overlap with a mating panel flange and further configured to compensate for thermal expansion.

13. The impact absorption panel of claim 7 wherein the plurality of projections include an open bottom area between projections configured to store water in a rain event.

14. The impact absorption panel of claim 13 wherein the open bottom area between projections can store up to at least 25 mm of water.

15. The impact absorption panel of claim 13 wherein the open bottom area between projections is configured to create a dead insulating airspace to inhibit frost penetration.

16. An impact absorption panel system comprising:

a first panel having a top surface, a bottom surface, a first edge having a flange that is offset from the top surface and a second edge having a flange that is offset from the bottom surface, a plurality of projections are disposed across the bottom surface and projecting downwardly, the projections having a first spring rate characteristic and a second spring rate characteristic; and a second panel having a top surface, a bottom surface, a first edge having a flange that is offset from the top surface and a second edge having a flange that is offset from the bottom surface, a plurality of projections are disposed across the bottom surface and projecting downwardly, the projections having a first spring rate characteristic and a second spring rate characteristic, wherein one of the second panel first edge flange and second edge flange engages one of the first panel second edge flange and the first panel first edge flange to form a base layer configured to have a generally continuously flat top surface.

17. The impact absorption panel system of claim 16 wherein the first edge flange of the first and second panels has one of a locking aperture and a locking projection and the second edge flange of the first and second panels has the other of a locking aperture and a locking projection.

18. The impact absorption panel system of claim 16 wherein one of an artificial turf, an athletic mat, a carpet, and a particulate layer is disposed over the cooperating first and second panels.

19. An impact absorption panel comprising:

a top surface having a three dimensional textured surface and a plurality of intersecting drainage channels;

a bottom surface spaced apart from the top surface and defining a panel section therebetween;

a plurality of projections projecting downwardly and disposed across at least a portion of the bottom surface, the projections having a first stage that defines a first spring rate characteristic and a second stage defining a second spring rate characteristic wherein the first spring rate characteristic provides for more deflection under load than the second spring rate characteristic, the plurality of projections cooperating during deflection under load such that the adjacent projections provide a load absorption gradient over a larger area than the area directly loaded, the first stage having a smaller volume of material than the second stage, and wherein adjacent projections define a bottom surface channel to form a plurality of intersecting bottom surface channels; and a plurality of drain holes connecting the top surface drainage channels with the plurality of bottom surface channels at the drainage channel intersections.

20. The impact absorption panel of claim 19 wherein the first stage is configured to collapse initially when subjected to an impact load, the second stage is configured to provide greater resistance to the impact load than the first stage, and the panel section is configured to provide greater resistance to the impact load than the first and second stages, the first stage being further configured to compress and telescopically deflect into the second stage, and wherein a portion of the bottom surface is generally coplanar with the truncated ends of adjacent projections such that the coplanar bottom surface portion is configured to provide a substantial resistance to deflection under load compared with the first and second stages.

* * * * *